US006050227A

United States Patent [19]

LaMotte

[11] Patent Number: 6,050,227

[45] Date of Patent: Apr. 18, 2000

[54] POWER PLANT BOILER CLEANER

[75] Inventor: Robert R. LaMotte, Omaha, Nebr.

[73] Assignee: Meylan Enterprises, Omaha, Nebr.

[21] Appl. No.: 09/007,401

[22] Filed: Jan. 15, 1998

[51] Int. Cl.[7] ..... F22B 37/54; B08B 3/02

[52] U.S. Cl. ..... 122/379; 134/172

[58] Field of Search ..... 122/379, 390; 134/172, 179; 15/316.1, 318

[56] References Cited

U.S. PATENT DOCUMENTS

| | | | |
|---|---|---|---|
| D. 347,498 | 5/1994 | Cannon | D32/14 |
| 3,903,912 | 9/1975 | Ice, Jr. et al. | 134/167 C |
| 4,028,136 | 6/1977 | Kamp | 134/8 |
| 4,095,305 | 6/1978 | Goodwin | 15/104.1 R |
| 4,174,549 | 11/1979 | Michelson | 15/318 |
| 4,207,648 | 6/1980 | Sullivan et al. | 15/316.1 |
| 4,498,427 | 2/1985 | Todd | 122/379 |
| 4,756,770 | 7/1988 | Weems et al. | 134/37 |
| 4,773,357 | 9/1988 | Scharton et al. | 122/82 |
| 5,019,329 | 5/1991 | Franklin et al. | 376/316 |
| 5,036,871 | 8/1991 | Ruggieri et al. | 134/167 R |
| 5,107,873 | 4/1992 | Clinger | 134/56 R |
| 5,193,491 | 3/1993 | Oslin et al. | 122/401 |
| 5,348,234 | 9/1994 | Woude | 239/753 |
| 5,381,811 | 1/1995 | Boisture | 134/167 R |
| 5,579,726 | 12/1996 | Finucane | 122/379 |

*Primary Examiner*—Denise L. Ferensic
*Assistant Examiner*—Gregory A. Wilson
*Attorney, Agent, or Firm*—Zarley, McKee, Thomte, Voorhees & Sease; Dennis L. Thomte

[57] ABSTRACT

A cleaning apparatus for a boiler including a boiler enclosure having a plurality of spaced-apart heat exchange tubes positioned therein comprising a movable support positioned outwardly of the boiler enclosure having a first, elongated hollow pipe extending therefrom which is introduced into the boiler enclosure. A pair of spray arms are mounted on the end of the first pipe and rotate with the pipe to supply high pressure cleaning water onto the tubes so that debris is washed from the heat exchange tubes. An optional cooling jacket is also described which may be positioned around the first pipe for cooling the first pipe.

20 Claims, 11 Drawing Sheets

POWER PLANT BOILER CLEANER

BACKGROUND OF THE INVENTION

1. Field of the Invention

This invention relates to a power plant boiler cleaning apparatus and more particularly to a power plant boiler cleaning apparatus which may be utilized while the power plant boiler is on-line.

2. Description of the Related Art

In very large power plants, the boiler thereof includes a coal furnace within an enclosure wherein there are multiple rows of hanging heat exchange pipes or tubes which may be either vertically disposed or horizontally disposed. The heat exchange tubes have water passing therethrough which is heated by the furnace for creating steam to operate the power plant generators. When the exterior surfaces of the steel pipes or tubes are clean, there is very good heat transfer between the hot air within the boiler and the pipes for efficiently heating the water in the pipes. The temperature within the boiler may be approximately 2,500° F. The coal furnace, however, releases coal ash which turbulently flies through the boiler which sticks or adheres to the pipes thereby forming a cement-like coating around the pipes. The heat transfer from the hot air in the boiler to the coated pipes decreases and the overall power plant becomes more inefficient, requiring greater consumption of coal for the amount of steam produced. Therefore, it is necessary to go into the boiler and clean the coal ash from the pipes on a regular basis, perhaps several times a year. Heretofore, it was necessary that the power plant boiler be shut down to enable workers to go into the boiler enclosure to manually chip the coal ash from the steel pipes. Such a procedure is a monumental job and is prohibitively expensive because of the cost of the downtime of the boiler and the cost of getting the boiler back on-line.

SUMMARY OF THE INVENTION

A cleaning apparatus for a power plant boiler is described with the boiler including a boiler enclosure having a plurality of spaced-apart heat exchange tubes positioned therein. The apparatus of this invention includes a movable support which is positioned outwardly of the boiler enclosure and which has a first, elongated hollow pipe extending therefrom. The movable support includes means for connecting one end of the first pipe to a source of high pressure cleaning water. A pair of spray arms are secured to the other end of the pipe for spraying the high pressure cleaning water onto the heat exchange tube. The movable support includes means for rotating the first pipe about its longitudinal axis. The movable support is movable towards the boiler enclosure at a predetermined rate whereby the rotating spray arms will be progressively moved through the interior of the boiler enclosure.

DESCRIPTION OF THE PREFERRED EMBODIMENT

Figure 1:
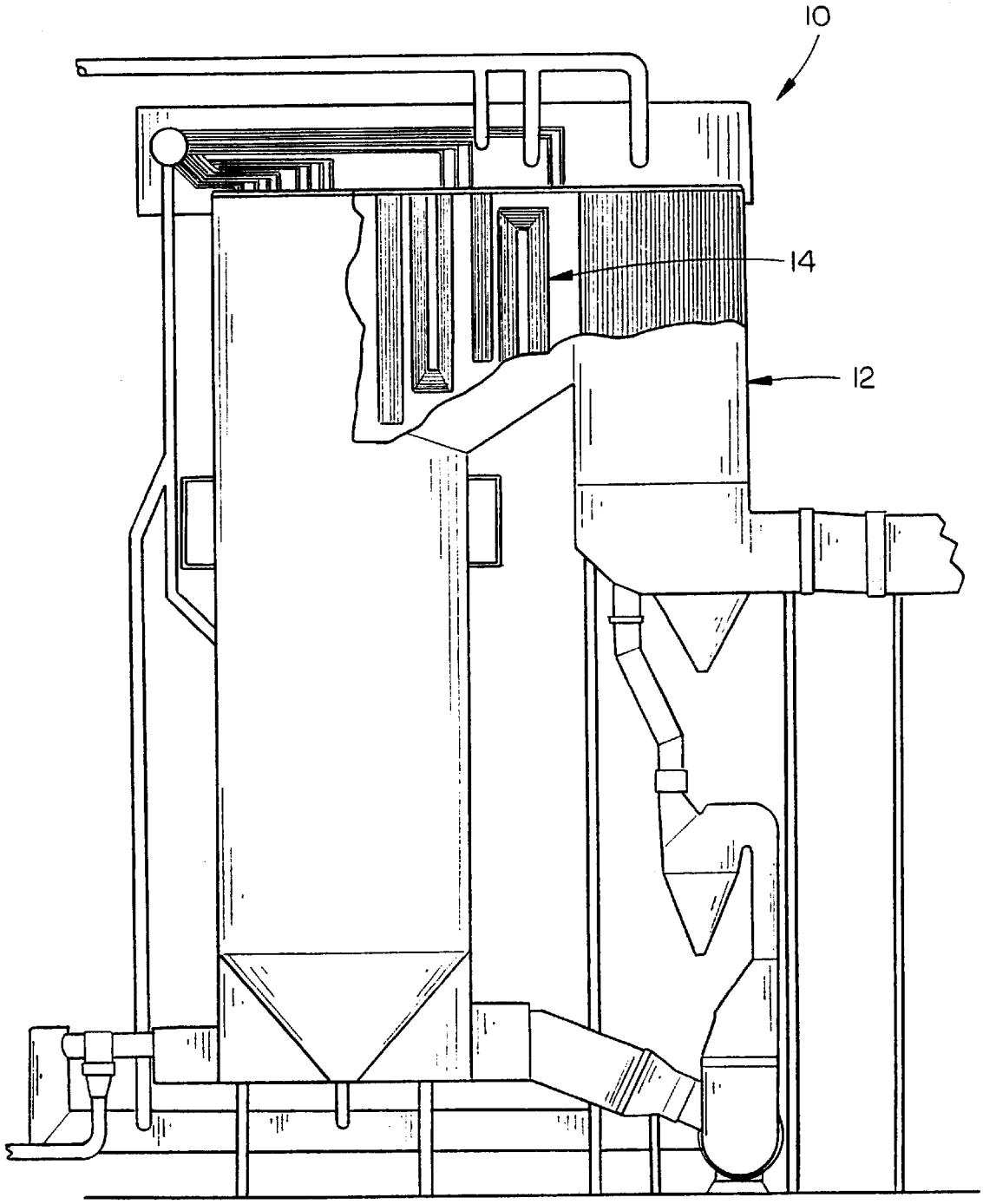
FIG. 1 is a schematic diagram of a power plant boiler with portions broken away to show the banks of hanging heat exchange tubes within the boiler enclosure which are to be cleaned by the apparatus of this invention.
Figure 5:
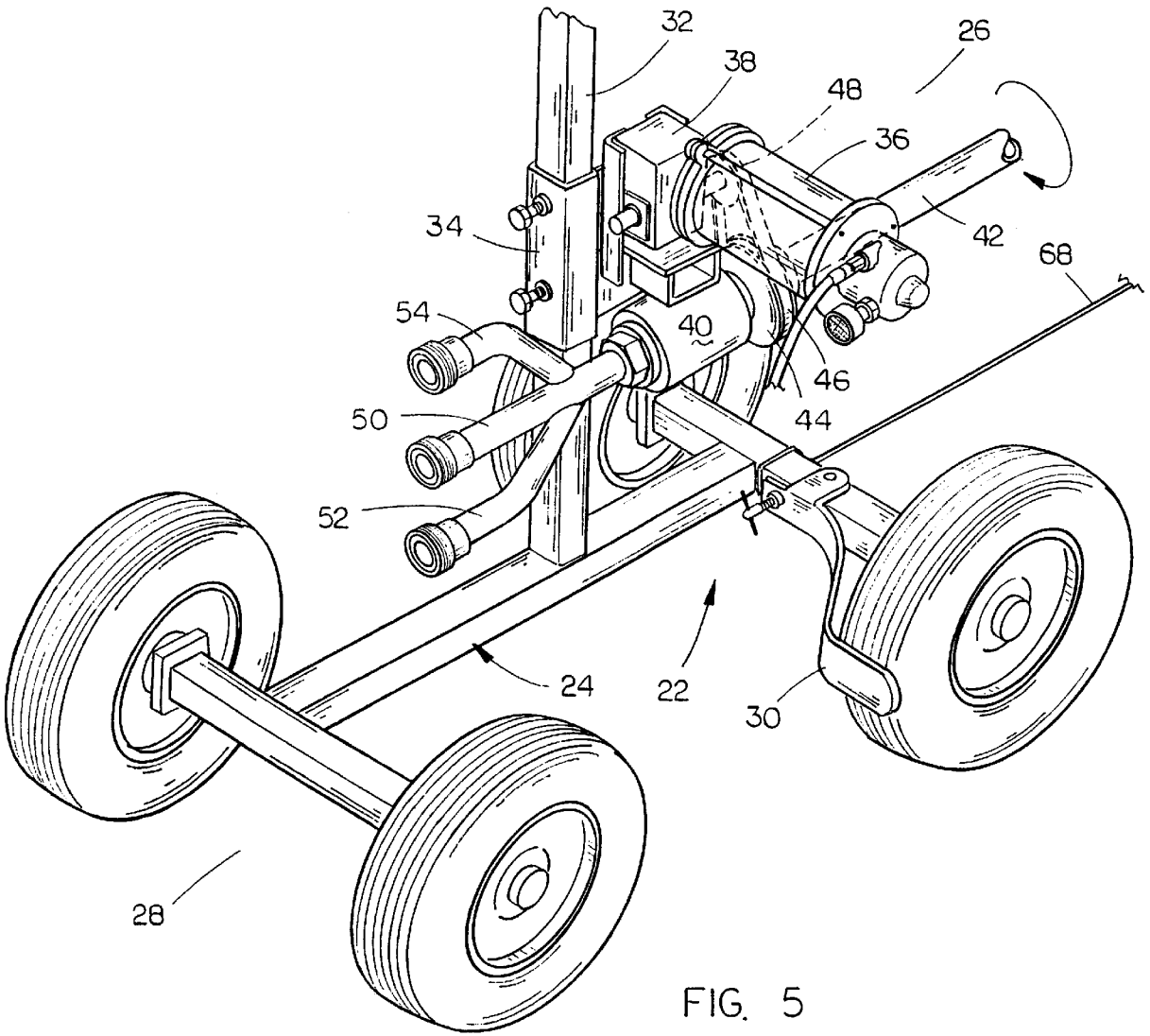
FIG. 5 is a perspective view of the wheeled, movable support including a pipe-rotating apparatus.

In FIG. 1, the numeral 10 refers to a conventional coal-fired power plant boiler generally including an enclosure 12 which encloses banks of hanging heat exchange pipes or tubes 14 which are to be cleaned by the apparatus of this invention. Enclosure 12 is normally provided with a plurality of openings 16 formed therein. Heretofore, when the heat exchange tubes 18 of the banks of tubes 14 became clogged with coal ash debris, it was necessary for the boiler to be shut down and cooled. Workers would then enter the interior of the enclosure 12 through the openings 16 and attempt to remove the debris from the tubes 18 by the use of hand-held high pressure fire hoses or the like. Not only is the use of the hand-held, high pressure fire hoses dangerous, it is very costly to take the boiler off-line for the cleaning procedure. It is for those reasons that the apparatus of this invention has been provided and which is referred to generally by the reference numeral 20. Apparatus 20 includes a movable support 22 including a wheeled frame 24 having a forward end 26 and a rearward end 28. As seen in FIG. 5, a spring-loaded brake 30 frictionally engages one of the wheels of the support 22 to yieldably resist the movement of the support.

Support 22 includes a vertical post 32 upon which is selectively vertically adjustably mounted a framework 34. Framework 34 supports motor 36, gearbox 38 and a rotary manifold sleeve 40. Pipe 42 has its outer end fluidly and rotatably connected to the sleeve 40 in conventional fashion. Pulley 44 is operatively connected to the outer end of the pipe 42 for rotating the same, as indicated by the arrow in FIG. 5. Pulley 44 is driven by belt 46 which in turn is driven by the pulley 48 on the gearbox 38. Motor 36 may be either electrically operated or hydraulically operated. Sleeve 40 has a pipe 50 operatively connected to the inlet side thereof with pipes 52 and 54 being fluidly connected to the pipe 50 (FIG. 5). Each of the pipes 50, 52 and 54 is preferably selectively connected to a source of high pressure cleaning fluid such as water or the like so that the high pressure cleaning fluid may be supplied to the interior of pipe 42.

Figure 2:
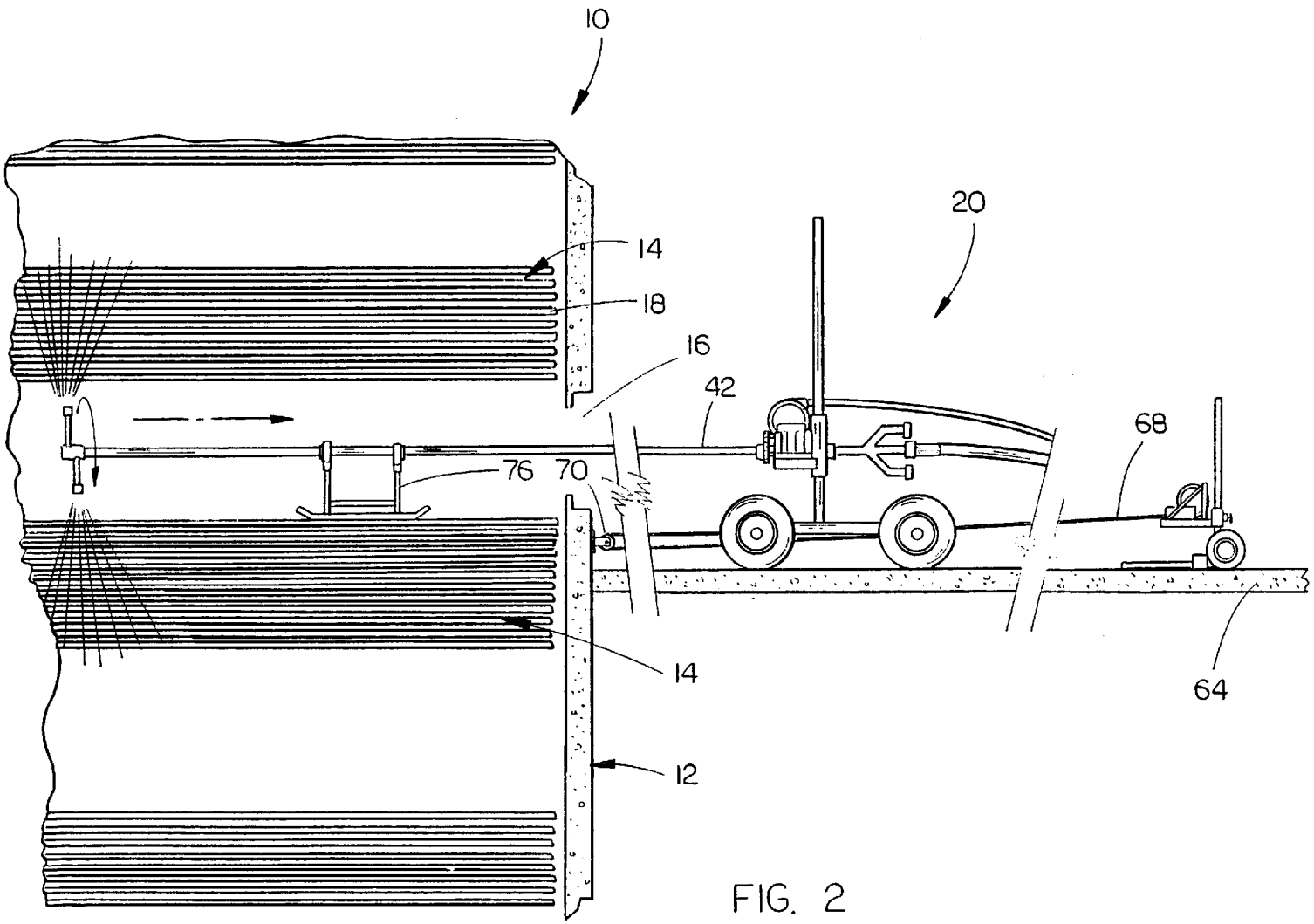
FIG. 2 is a foreshortened side view of the apparatus showing the pressurized water pipe supported on a sled, which is positioned within the boiler, and also showing the means for moving the movable support towards the boiler enclosure.
Figure 3:
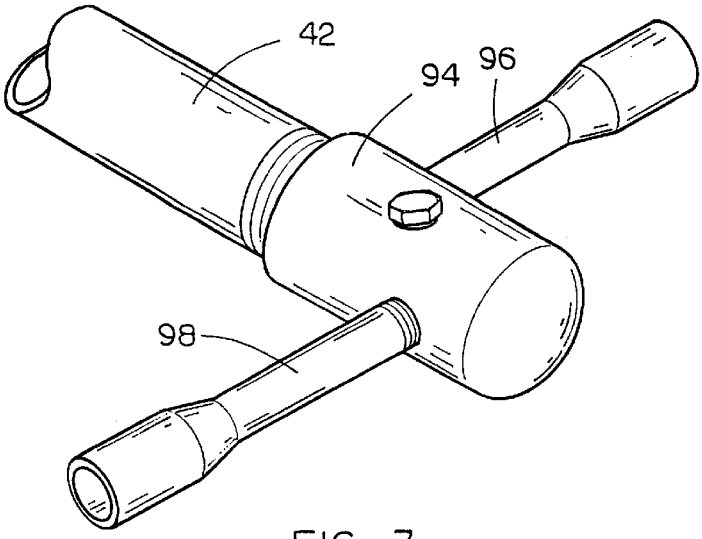
FIG. 3 is an enlarged perspective view of the dual spray arms or nozzles which are mounted on the outer end of the high pressure water delivery pipe.
Figure 6:
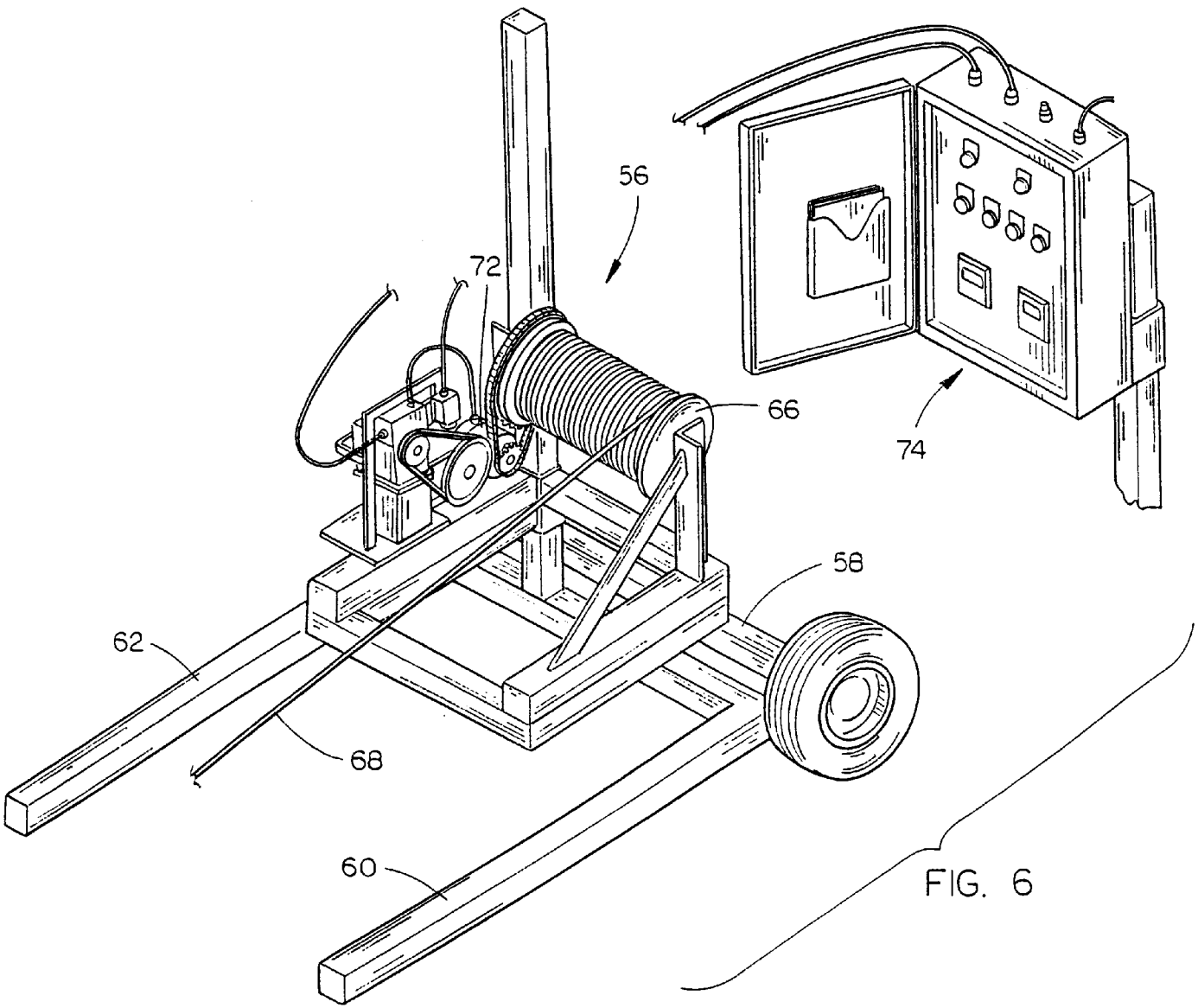
FIG. 6 is a perspective view of the winch cable puller and the control box for the winch cable puller.

Referring to FIG. 6, the numeral 56 refers to a winch assembly which is positioned rearwardly of the rearward end of the support 22, as illustrated in FIG. 2. Winch assembly 56 includes a wheeled frame 58 including a pair of frame members 60 and 62 which are selectively positioned in engagement with the supporting surface 64 to prevent movement of the winch assembly 56 during its use to propel or move the support 22 towards the boiler enclosure. Winch assembly 56 includes a winch drum 66 having a winch cable 68 mounted thereon and extending therefrom. Winch cable 68 extends from winch assembly 56 to a pulley connection or the like 70 secured to the exterior surface of the enclosure 12 and then extending to the support 22 to which it is connected. Accordingly, as the cable 68 is wound upon the drum 66 by the motor 72, the support 22 is moved towards the boiler enclosure, as will be described hereinafter. The rate at which the cable 68 is wound onto the cable drum 66 is controlled by the programmable controller 74.

Figure 4:
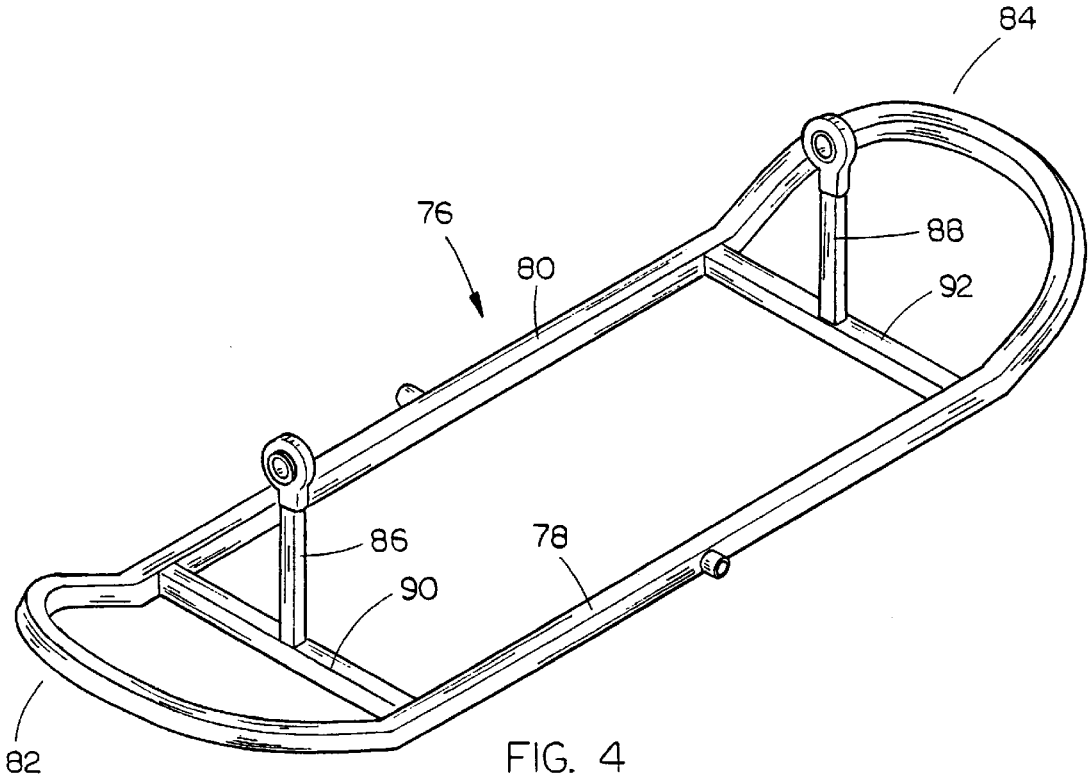
FIG. 4 is a perspective view of the sled which is used for rotatably supporting the high pressure water delivery pipe within the boiler.

FIG. 2 illustrates the pipe 42 extending from support 22 through the opening 16 in the enclosure 12. Preferably, the pipe 42 in the boiler enclosure is supported by a sled 76, as best seen in FIG. 4. Sled 76 includes a pair of hollow sled runners 78 and 80 which are interconnected by the end members 82 and 84, respectively. Upstanding supports 86 and 88 extend upwardly from connecting tubes 90 and 92, respectively, and are adapted to rotatably support the pipe 42 at the upper ends thereof. The hollow interiors of the members 78, 80, 82, 84, 86, 88, 90 and 92 are preferably in communication with a source of cooling water delivered thereto by any convenient means to keep the sled 76 from melting during its use in the extremely high temperature boiler.

The outer end of the pipe 42 is closed by a cap 94 which has a pair of spray arms 96 and 98 threadably mounted therein and which extend laterally or transversely therefrom. As seen in the drawings, the spray arms 96 and 98 are offset with respect to one another to enable the spray arms to be inserted through small openings in the boiler enclosure. The offset relationship of the spray arms 96 and 98 enables the pipe 42 to be angled with respect to the enclosure opening so that one of the spray arms 96 may be first introduced through the opening in the enclosure with the pipe 42 then being angled so that the other spray arm may be introduced through the opening in the enclosure much like a large piece of furniture is moved through a doorway or the like.

Figure 9:
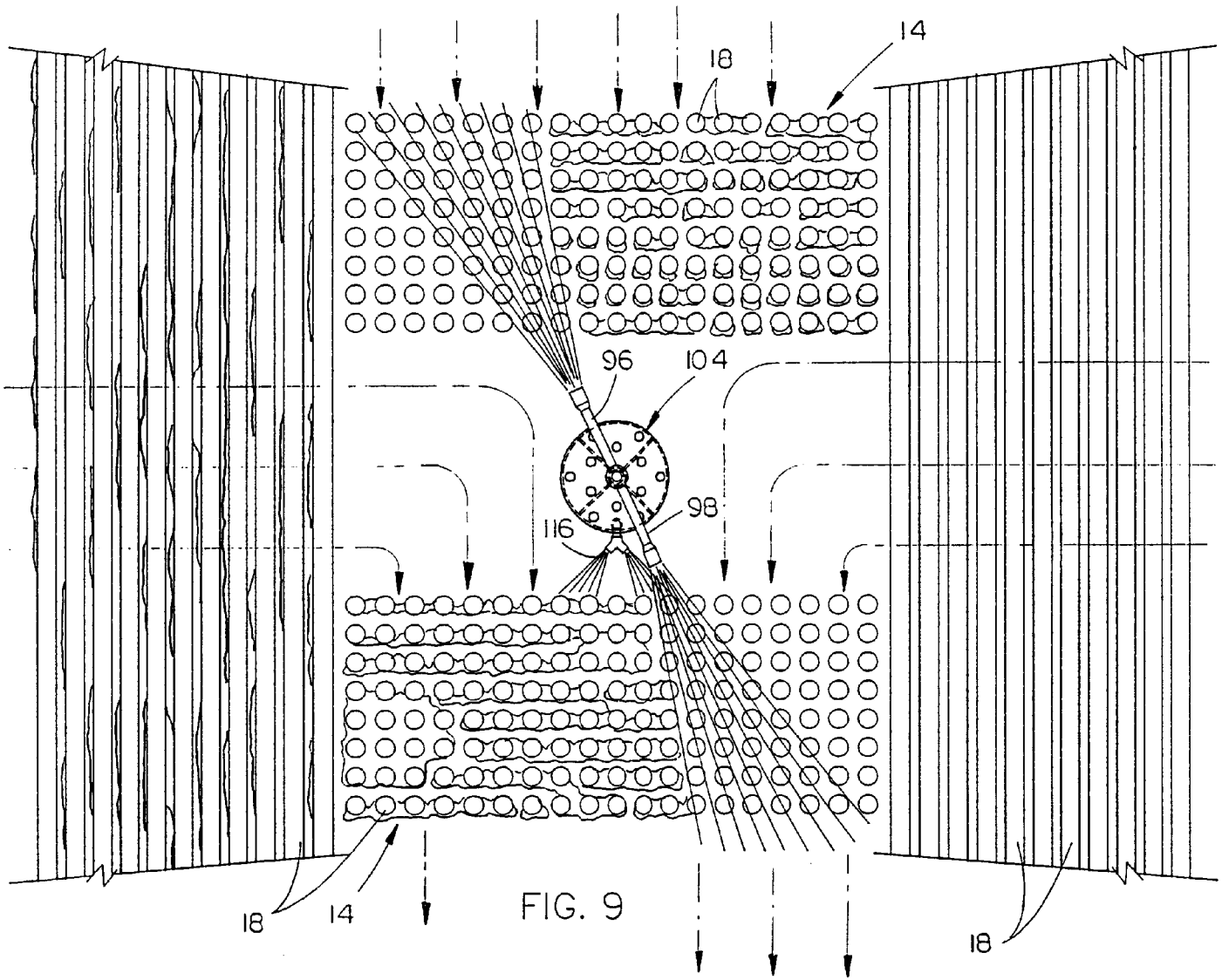
FIG. 9 is a view from within the boiler illustrating the cleaning action of the high pressure water for removing debris from the heat exchange tubes.
Figure 10:
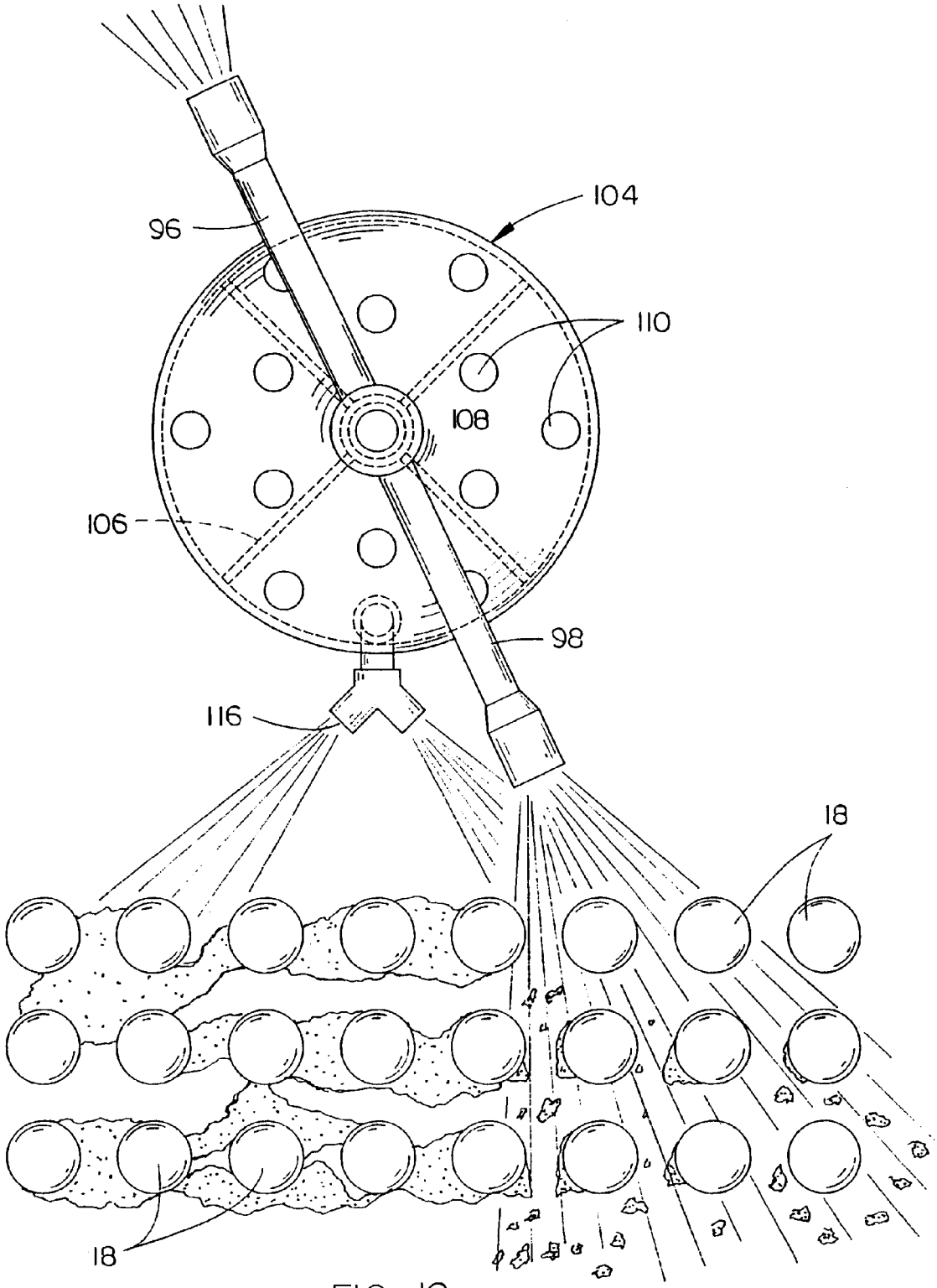
FIG. 10 is an enlarged end view of the cleaning assembly showing the cleaning action of the high pressure water for removing debris from the heat exchange tubes.

In operation, the support 22 is positioned with respect to the boiler so that the spray arms 96 and 98 are positioned just inwardly of the opening 16 in the enclosure 12. The winch assembly 56 is then properly positioned and the controller 74 actuated. A high pressure cleaning fluid such as water or the like is then delivered to the interior of the pipe 42 as previously described. Pipe 42 is rotated by the motor 36 which causes the (cooling) high pressure water to be discharged from the outer ends of the spray arms 96 and 98 in the manner illustrated in FIGS. 9 and 10 so that the high pressure water is directed onto the heat exchange or boiler tubes 18 to remove the debris therefrom. The rotary action of the spray arms 96 and 98 causes the high pressure cleaning water to be directed onto the heat exchange tubes even though those tubes may be located several feet away from the spray arms. FIG. 2 illustrates the apparatus 20 being used to remove debris from horizontally disposed banks of tubes, but it should be understood that the apparatus may be likewise used to clean the debris from vertically disposed tubes.

The apparatus 20 may be used to clean the heat exchange tubes in the boiler, even though the boiler is still on-line thereby resulting in a tremendous saving, since it is quite costly to shut the boiler down and let the same cool to enable workers to enter the interior of the boiler, and then re-fire the boiler.

Figure 8:
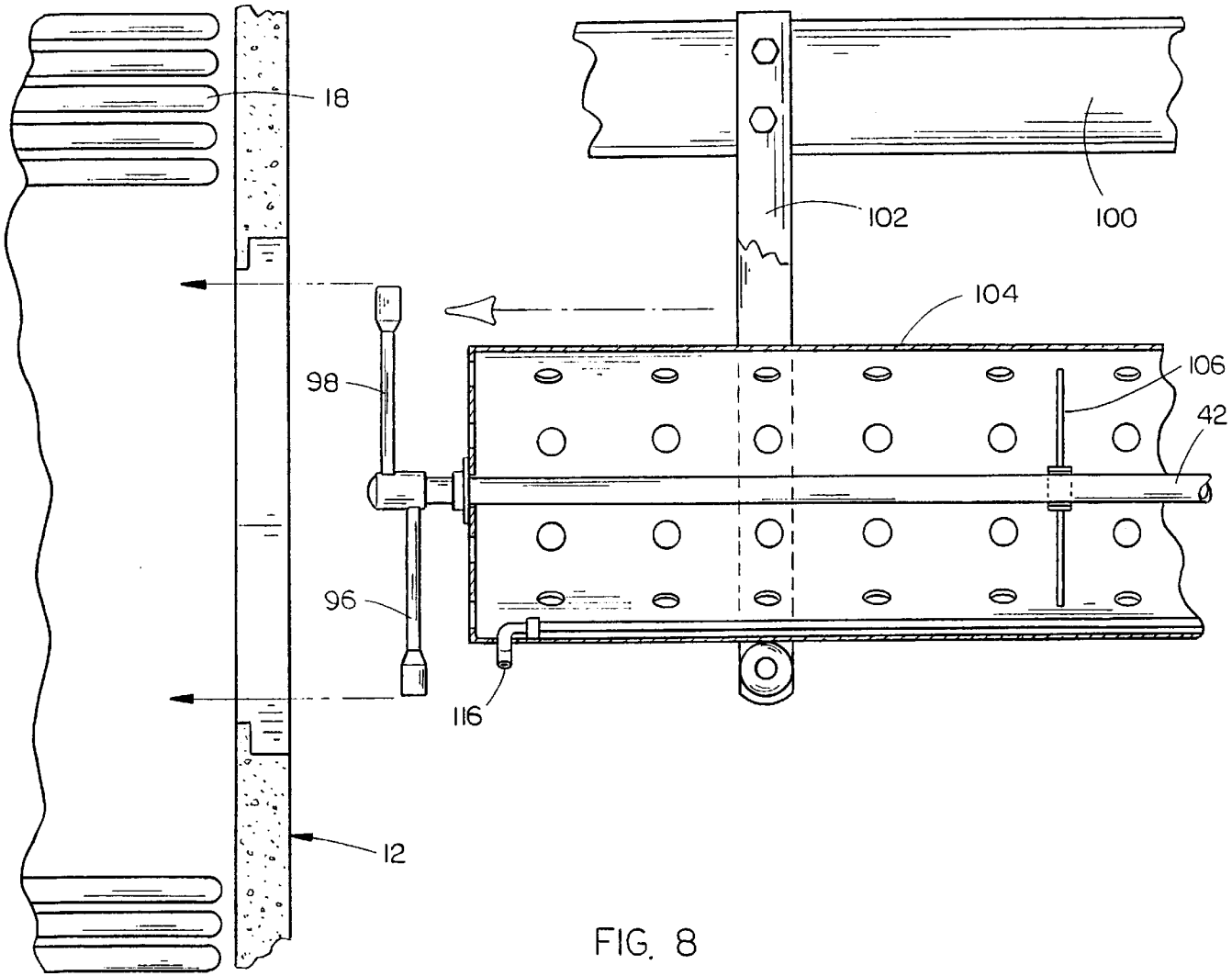
FIG. 8 is a partial sectional side view showing the cleaning assembly supported on rollers secured to straps suspended from the building framework.

Although it is preferred that the support 22 be incrementally moved towards the boiler by means of the computer-controlled winch apparatus 56, the movable support 22 may be manually moved with respect to the boiler, if so desired. Further, the pipe 42 may be longitudinally horizontally movably supported by a horizontally disposed beam 100 having a plurality of hanger straps 102 extending downwardly therefrom adapted to support the pipe 42, as seen in FIG. 8.

Figure 7:
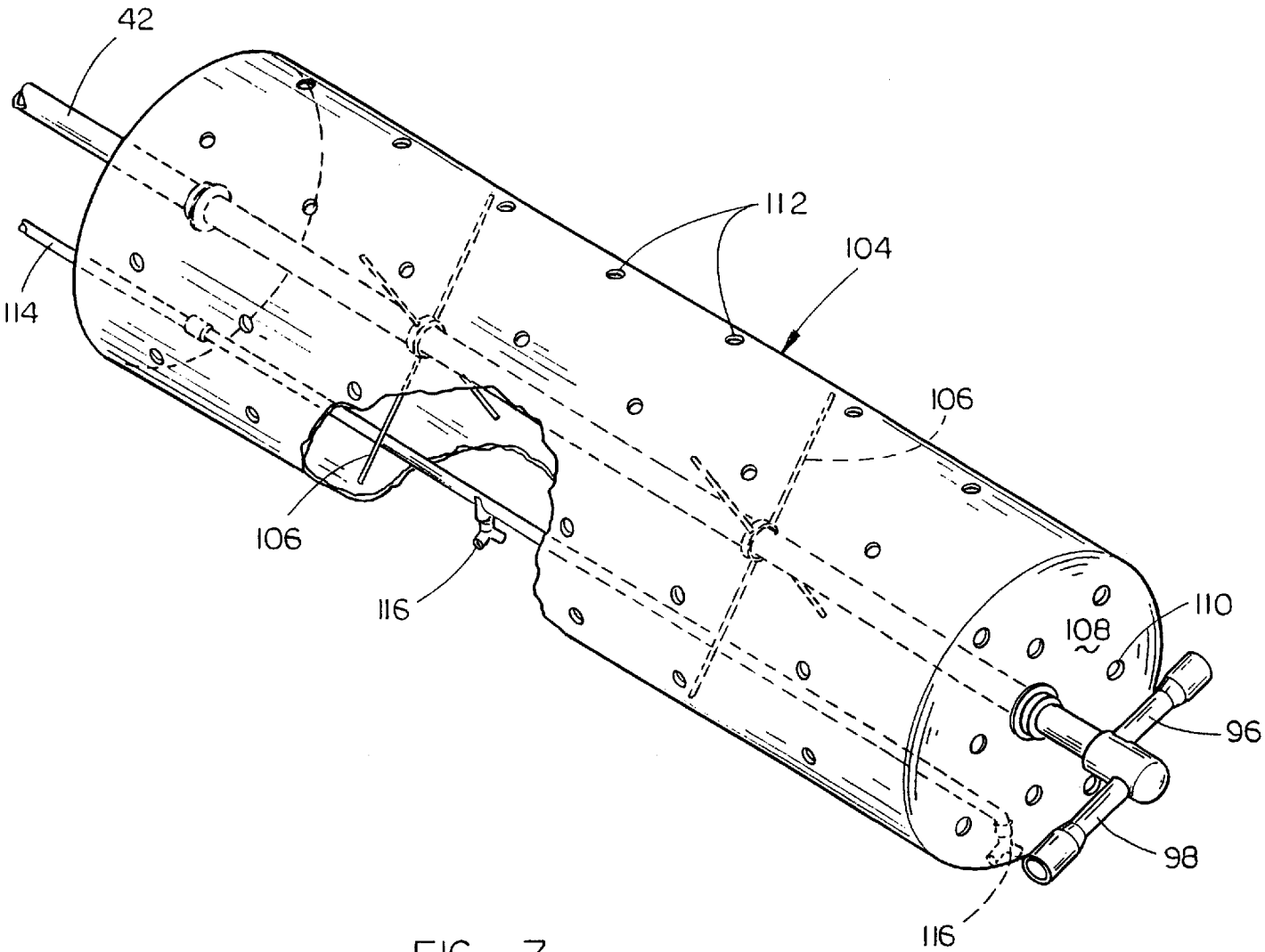
FIG. 7 is a partially cut away perspective view of the high pressure water delivery pipe rotatably supported centrally of a larger cooling pipe or tube and which also shows a second water delivery pipe positioned along the bottom of the cooling pipe with the downturned nozzle heads for supporting the pipe against bending within the hot boiler.

A modified version of the apparatus is disclosed in FIG. 7 and is designed to be used in those environments wherein the heat is so great in the boiler that it is necessary to cool the pipe 42 to prevent the same from being so overheated that the pipe would simply melt or at least bend under the tremendous heat. In such a situation, an outer cooling tube 104 is positioned over the pipe 42 and is supported thereon by a plurality of X-shaped supports 106. The inner end 108 of the tube 104 is provided with a plurality of openings 110 formed therein. Cooling water is supplied to the interior of tube 104 and is discharged outwardly therefrom through the openings 110 to cool the spray arms 96 and 98 as well as the outer end of the pipe 42 to prevent the overheating of the same. Further, it is preferred that the tube 104 have a plurality of openings 112 formed in the side wall thereof to aid in cooling the tube 104 itself.

A small water conduit 114 may also be extended downwardly through the interior of tube 104, as seen in FIG. 7, and which has one or more nozzles 116 provided along the length thereof which are positioned outwardly of the tube 104. In some situations, the length of the pipe 42 and the tube 104 is such that they will tend to droop. Thus, the force of the water being discharged downwardly from the nozzles 116 will create a reactive force which will tend to lift the pipe 42 and the tube 104 upwardly to counteract the weight thereof.

Figure 11:
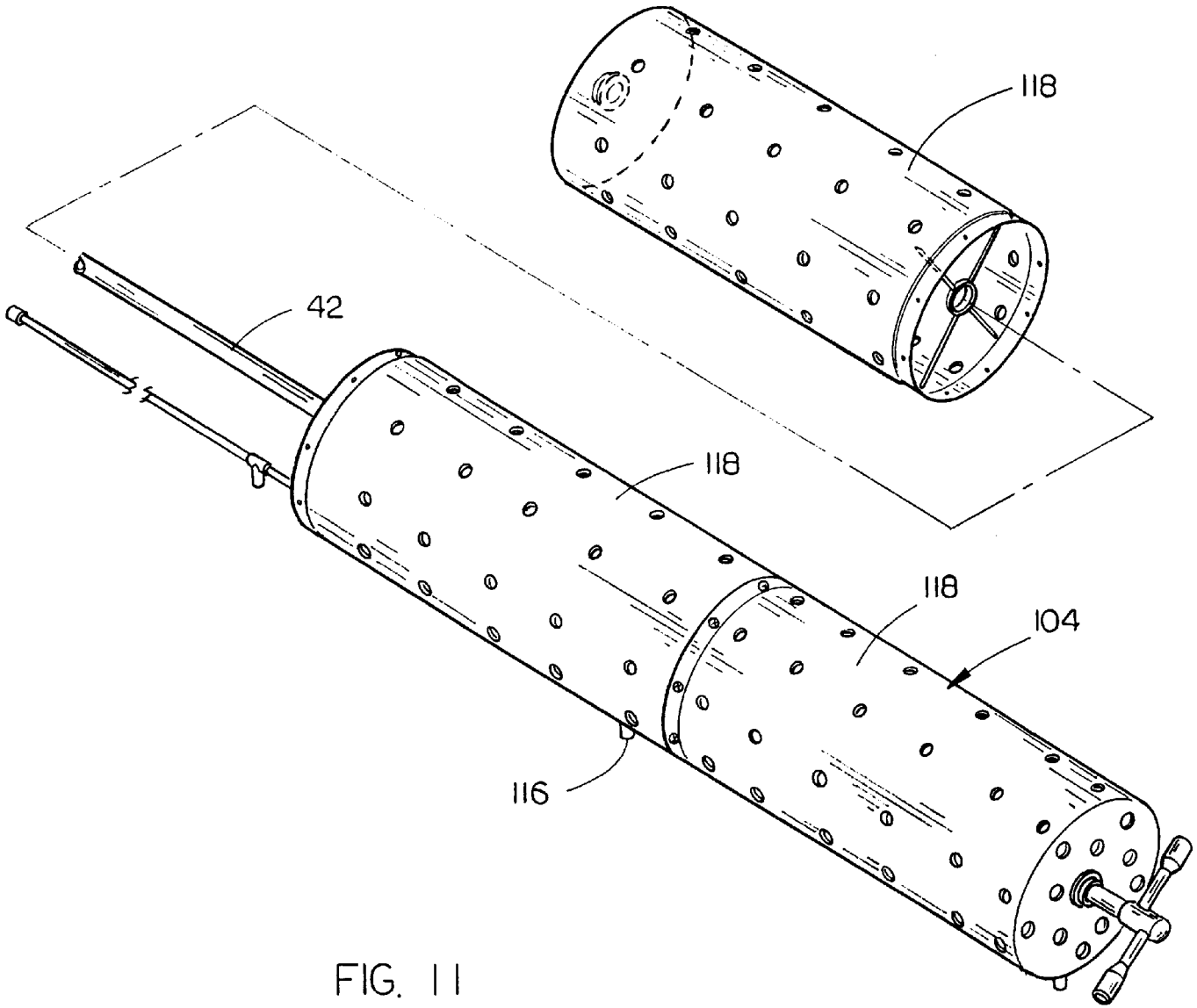
FIG. 11 is a perspective view of a modified cleaning assembly wherein the cooling tube is provided in modular sections for assembling whatever length is required.

A further embodiment is illustrated in FIG. 11 which is essentially identical to that previously described, but which shows the cooling tube 104 to be constructed of a plurality of modules 118 which are connected together in an end-to-end relationship to achieve whatever desired length of tube 104 is desired.

Figure 12:
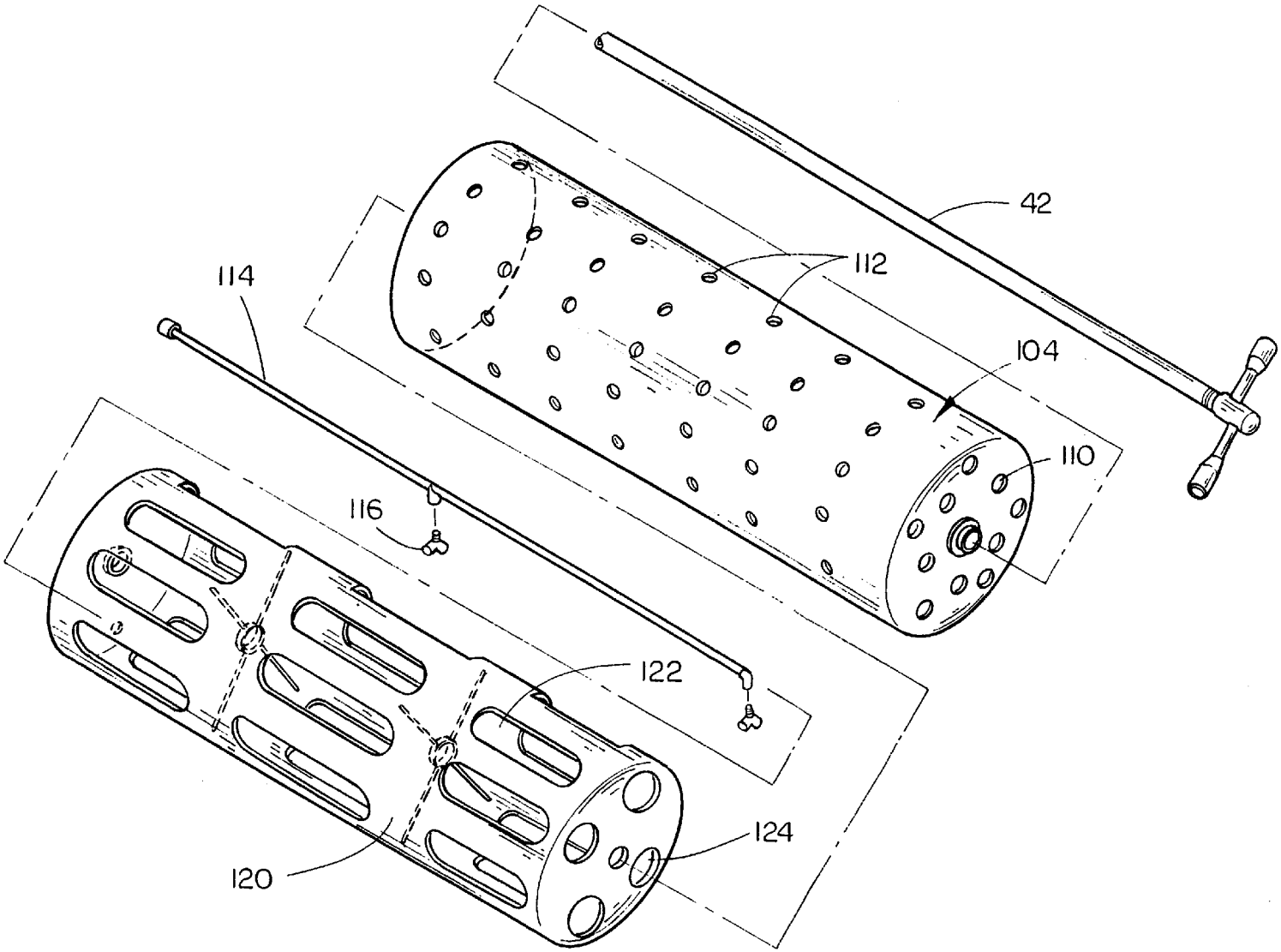
FIG. 12 is an exploded perspective view of a further alternative embodiment wherein the cooling pipe or tube has a stiffening cylinder provided therein for stiffening the cooling tube from bending.

Yet another modified version of the apparatus is illustrated in FIG. 12 wherein the cooling tube 104 has an optional stiffener tube 120 placed therein and which has a plurality of elongated slots 122 formed in the side wall thereof and openings 124 formed in the end thereof.

Thus it can be seen that a novel boiler cleaning apparatus has been provided which enables the heat exchange tubes in the boiler to be cleaned, through high pressure water, without the need for taking the boiler off-line and permitting the same to cool. The apparatus of this invention is much safer than the former procedure of workers entering the interior of the boiler and attempting to remove the debris from the heat exchange tubes through the use of high pressure fire hoses. It can also be seen that a novel means has been provided for progressively moving the pipe 42 inwardly into the boiler so that the desired cleaning operation is achieved. It can also be seen that a novel means has been provided for ensuring that the tube 42 will not droop downwardly and that the same will not become overheated through the use of the cooling tube or jacket 104.

Thus it can be seen that the invention accomplishes at least all of its stated objectives.

I claim:

1. A cleaning apparatus for a boiler including a boiler enclosure having a plurality of spaced-apart heat exchange tubes positioned therein, comprising:

a movable support positioned outwardly of said boiler enclosure and having a forward end and a rearward end;

a first, elongated hollow pipe extending from said movable support;

said first pipe having a first end positioned at said movable support and a second end positioned horizontally outwardly therefrom;

said first end of said first pipe being in fluid communication with a source of high pressure fluid;

a first spray arm at said second end of said first pipe which is in fluid communication with the interior of said first pipe and which extends from said second end of said first pipe in a first direction;

a second spray arm at said second end of said first pipe which is in fluid communication with the interior of said first pipe and which extends from said second end of said first pipe in a second direction;

said movable support being movable toward said boiler enclosure whereby said second end of said first pipe may be introduced into the interior of said boiler enclosure;

said first and second spray arms being rotatable about the longitudinal axis of said first pipe whereby high pressure fluid will be discharged therefrom onto the heat exchange tubes to remove debris therefrom; and means for moving said movable support and said first pipe with respect to said boiler enclosure comprising a winch means.

2. The apparatus of claim 1 further including means on said movable support for rotating said first pipe about its longitudinal axis.

3. The apparatus of claim 1 further including means for moving said movable support and said first pipe with respect to said boiler enclosure at a predetermined rate.

4. The apparatus of claim 3 wherein said means for moving said movable support comprises a programmable controlled winch means.

5. The apparatus of claim 1 wherein a downwardly directed water nozzle is provided at said second end of said first pipe, said water nozzle being in communication with a source of pressurized water whereby the reactant force of the water being discharged from said water nozzle will tend to prevent said second end of said first pipe from drooping downwardly.

6. The apparatus of claim 1 wherein said first and second spray arms are elongated and are offset with respect to one another.

7. A cleaning apparatus for said boiler including a boiler enclosure having a plurality of spaced-apart heat exchange tubes positioned therein, comprising:

a movable support positioned outwardly of said boiler enclosure and having a forward end and a rearward end;

a first, elongated hollow pipe extending from said movable support;

said first pipe having a first end positioned at said movable support and a second end positioned horizontally outwardly therefrom;

said first end of said first pipe being in fluid communication with a source of high pressure fluid;

a first spray arm at said second end of said first pipe which is in fluid communication with the interior of said first pipe and which extends from said second end of said first pipe in a first direction;

a second spray arm at said second end of said first pipe which is in fluid communication with the interior of said first pipe and which extends from said second end of said first pipe in a second direction;

said movable support being movable toward said boiler enclosure whereby said second end of said first pipe may be introduced into the interior of said boiler enclosure;

said first and second spray arms being rotatable about the longitudinal axis of said first pipe whereby high pressure fluid will be discharged therefrom onto the heat exchange tubes to remove debris therefrom; and a movable sled being positioned in the boiler enclosure for supporting said first pipe thereon.

8. The apparatus of claim 6 wherein said sled rotatably supports said first pipe.

9. The apparatus of claim 6 wherein said sled is water cooled.

10. The apparatus of claim 6 wherein said sled is comprised of a supporting frame structure having cooling water flowing therethrough.

11. A cleaning apparatus for a boiler including a boiler enclosure having a plurality of spaced-apart heat exchange tubes positioned therein, comprising:

a movable support positioned outwardly of said boiler enclosure and having a forward end and a rearward end;

a first, elongated hollow pipe extending from said movable support;

said first pipe having a first end positioned at said movable support and said second end positioned horizontally outwardly therefrom;

said first end of said first pipe being in fluid communication with a source of high pressure fluid;

a first spray arm at said second end of said first pipe which is in fluid communication with the interior of said first pipe and which extends from said second end of said first pipe in a first direction;

a second spray arm at said second end of said first pipe which is in fluid communication with the interior of said first pipe and which extends from said second end of said first pipe in a second direction;

said movable support being movable toward said boiler enclosure whereby said second end of said first pipe may be introduced into the interior of said boiler enclosure;

said first and second spray arms being rotatable about the longitudinal axis of said first pipe whereby high pressure fluid will be discharged therefrom onto the heat exchange tubes to remove debris therefrom; and a cooling tube surrounding said first pipe for at least a portion of its length to define a chamber therebetween; said chamber being in communication with a source of cooling fluid.

12. The apparatus of claim 11 wherein said cooling tube has a plurality of openings formed therein for permitting the discharge of cooling fluid therethrough.

13. The apparatus of claim 11 wherein said cooling tube has at least one opening formed therein for directing cooling fluid onto the said second end of said first pipe.

14. The apparatus of claim 11 wherein said cooling tube has at least one opening formed therein for directing cooling fluid onto the said second end of said first pipe and said first and second spray arms.

15. The apparatus of claim 11 wherein a stiffener is positioned in said chamber for stiffening said cooling tube.

16. The apparatus of claim 15 wherein said stiffener comprises a perforated tubular member.

17. The apparatus of claim 11 wherein said cooling tube is comprised of a plurality of tube modules positioned in an end-to-end relationship.

18. A cleaning apparatus for a boiler including a boiler enclosure having a plurality of spaced-apart heat exchange tubes positioned therein, comprising:

a movable support positioned outwardly of said boiler enclosure and having a forward end and a rearward end;

a first, elongated hollow pipe extending from said movable support;

said first pipe having a first end positioned at said movable support and a second end positioned horizontally outwardly therefrom;

said first end of said first pipe being in fluid communication with a source of high pressure fluid;

a spray nozzle at said second end of said first pipe which is in fluid communication with the interior of said first pipe;

said movable support being movable towards said boiler enclosure whereby said second end of said first pipe may be introduced into the interior of said boiler enclosure;

said spray nozzle being positioned on said first pipe whereby high pressure fluid will be discharged therefrom onto the heat exchange tubes to remove debris therefrom.

19. The apparatus of claim 18 further including means for rotating said spray nozzle.

20. A cleaning apparatus for a boiler including a boiler enclosure having a plurality of spaced-apart heat exchange tubes positioned therein, comprising:

a movable support positioned outwardly of said boiler enclosure and having a forward end and a rearward end;

a first, elongated hollow pipe extending from said movable support;

said first pipe having a first end positioned at said movable support and a second end positioned horizontally outwardly therefrom;

said first end of said first pipe being in fluid communication with a source of high pressure fluid;

a first spray arm at said second end of said first pipe which in fluid communication with the interior of said first pipe and which extends from said second end of said first pipe in a first direction;

a second spray arm at said second end of said first pipe which is in fluid communication with the interior of said first pipe and which extends from said second end of said first pipe in a second direction;

said movable support being movable toward said boiler enclosure whereby said second end of said first pipe may be introduced into the interior of said boiler enclosure;

said first and second spray arms being rotatable about the longitudinal axis of said first pipe whereby high pressure fluid will be discharged therefrom onto the heat exchange tubes to remove debris therefrom;

said movable support including a fluid manifold means for fluidly connecting said first end of said first pipe to a plurality of sources of high pressure fluid.

* * * * *